US010999907B2

(12) United States Patent
Qiu

(10) Patent No.: US 10,999,907 B2
(45) Date of Patent: May 4, 2021

(54) SELECTING PARAMETERS IN A COLOR-TUNING APPLICATION

(71) Applicant: Lumileds LLC, San Jose, CA (US)

(72) Inventor: Yifeng Qiu, San Jose, CA (US)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/726,125

(22) Filed: Dec. 23, 2019

(65) Prior Publication Data

US 2020/0351996 A1 Nov. 5, 2020

Related U.S. Application Data

(63) Continuation of application No. 16/403,265, filed on May 3, 2019, now Pat. No. 10,555,395.

(51) Int. Cl.

| | |
|---|---|
| ***H05B 45/20*** | (2020.01) |
| ***H05B 45/00*** | (2020.01) |
| ***H05B 45/10*** | (2020.01) |
| ***G09G 3/34*** | (2006.01) |

(52) U.S. Cl.

CPC ..... *H05B 45/20* (2020.01); *H05B 45/00* (2020.01); *H05B 45/10* (2020.01); *G09G 3/3413* (2013.01); *G09G 2320/0666* (2013.01)

(58) Field of Classification Search

CPC ..... H05B 45/20; G09G 2320/0666; G09G 3/3413

See application file for complete search history.

(56) References Cited

U.S. PATENT DOCUMENTS

| | | | |
|---|---|---|---|
| 8,729,812 | B2 | 5/2014 | Kuwu |
| 9,131,581 | B1 | 9/2015 | Hsia et al. |
| 9,730,291 | B1 | 8/2017 | Janik et al. |

(Continued)

FOREIGN PATENT DOCUMENTS

| | | | |
|---|---|---|---|
| DE | 112013006888 | T5 | 12/2015 |
| EP | 3247174 | A1 | 11/2017 |

(Continued)

OTHER PUBLICATIONS

"U.S. Appl. No. 16/258,193, Notice of Allowance dated Jun. 18, 2019", 9 pgs.

(Continued)

*Primary Examiner* — Monica C King

(74) *Attorney, Agent, or Firm* — Schwegman Lundberg & Woessner, P.A.

(57) ABSTRACT

Various embodiments include apparatuses enabling a single color-tuning device to select both a correlated color temperature (LED) and a coordinate distance ($D_{uv}$) to a black body line (BBL) in a color-tuning application. In one embodiment, a color-tuning device is to divide an applied voltage to provide a signal related to parameters selected from at least one of LED and $D_{uv}$ from the BBL. A finite-state machine (LED) is coupled to the color-tuning device to receive the signals therefrom and determine an action to take based on both a current position and a previous position of the color-tuning device. The LED is to be coupled to a light-emitting diode (LED) array. Other apparatuses and devices are disclosed.

23 Claims, 6 Drawing Sheets

(56) References Cited

U.S. PATENT DOCUMENTS

| | | | | |
|---|---|---|---|---|
| 9,801,250 | B1 | 10/2017 | Halliwell | |
| 10,517,156 | B1 | 12/2019 | Qiu et al. | |
| 10,555,395 | B1 | 2/2020 | Qiu | |
| 10,652,962 | B1 | 5/2020 | Qiu | |
| 2007/0279440 | A1 | 12/2007 | Negley | |
| 2010/0072903 | A1 | 3/2010 | Blaut et al. | |
| 2010/0079088 | A1 | 4/2010 | Lipcsei et al. | |
| 2010/0109564 | A1 | 5/2010 | Shin et al. | |
| 2011/0115407 | A1 | 5/2011 | Wibben et al. | |
| 2013/0119872 | A1 | 5/2013 | Chobot | |
| 2014/0265919 | A1 | 9/2014 | Pope et al. | |
| 2014/0333216 | A1 | 11/2014 | Zhang et al. | |
| 2015/0237700 | A1* | 8/2015 | Woytowitz | H05B 47/19 315/307 |
| 2015/0351191 | A1 | 12/2015 | Pope et al. | |
| 2017/0127489 | A1 | 5/2017 | Zulim et al. | |
| 2017/0202071 | A1 | 7/2017 | Chen et al. | |
| 2017/0245338 | A1 | 8/2017 | Turunen | |
| 2017/0249755 | A1* | 8/2017 | Shih | G06T 11/001 |
| 2017/0374718 | A1 | 12/2017 | Fang et al. | |
| 2018/0146527 | A1 | 5/2018 | Yadav et al. | |
| 2019/0012511 | A1 | 1/2019 | Weaver et al. | |
| 2019/0116641 | A1* | 4/2019 | Wilson | H05B 45/20 |
| 2020/0367331 | A1 | 11/2020 | Qiu et al. | |

FOREIGN PATENT DOCUMENTS

| | | | |
|---|---|---|---|
| TW | 201436634 | A | 9/2014 |
| TW | I568311 | B | 1/2017 |
| WO | WO-2017131706 | A1 | 8/2017 |
| WO | WO-2020/226970 | A1 | 11/2020 |

OTHER PUBLICATIONS

"U.S. Appl. No. 16/403,265, Notice of Allowance dated Sep. 27, 2019", 10 pgs.
"U.S. Appl. No. 16/454,730, Notice of Allowance dated Jan. 8, 2020", 9 pgs.
"U.S. Appl. No. 16/454,730, Notice of Allowance dated Nov. 1, 2019", 11 pgs.
"U.S. Appl. No. 16/454,730, Supplemental Notice of Allowability dated Feb. 5, 2020", 2 pgs.
"European Application Serial No. 19205102.7, extended European Search Report dated Dec. 12, 2019", 7 pgs.
"U.S. Appl. No. 16/454,730, Supplemental Notice of Allowability dated Apr. 14, 2020", 2 pgs.
"U.S. Appl. No. 16/844,923, Preliminary Amendment filed Jun. 17, 2020", 8 pgs.
"European Application No. 19204908.8, extended European Search Report dated Apr. 8, 2020", 9 pgs.
"U.S. Appl. No. 16/457,130 Supplemental Amendment filed Oct. 26, 2020", 12 pgs.
"U.S. Appl. No. 16/457,130, Examiner Interview Summary dated Oct. 30, 2020", 2 pgs.
"U.S. Appl. No. 16/457,130, Notice of Allowance dated Nov. 5, 2020", 8 pgs.
"U.S. Appl. No. 16/457,130, Ex Parte Quayle Action dated Jul. 23, 2020", 7 pgs.
"U.S. Appl. No. 16/457,130, Response filed Sep. 22, 2020 to Ex Parte Quayle Action dated Jul. 23, 2020", 9 pgs.
"International Application Serial No. PCT/US2020/030485, International Search Report dated Jul. 16, 2020", 5 pgs.
"International Application Serial No. PCT/US2020/030485, Written Opinion dated Jul. 16, 2020", 9 pgs.
"International Application Serial No. PCT/US2020/039137, International Search Report dated Sep. 29, 2020", 5 pgs.
"International Application Serial No. PCT/US2020/039137, Written Opinion dated Sep. 29, 2020", 10 pgs.
"U.S. Appl. No. 16/457,130, Corrected Notice of Allowability dated Dec. 18, 2020", 2 pgs.
"U.S. Appl. No. 16/844,923, Non Final Office Action dated Dec. 24, 2020", 7 pgs.
"U.S. Appl. No. 16/844,923, Office Action dated Dec. 24, 2020", 7 pgs.
"Taiwanese Application Serial No. 109121726, Office Action dated Jan. 27, 2021", (w/ English Translation), 19 pgs.

* cited by examiner

SELECTING PARAMETERS IN A COLOR-TUNING APPLICATION

CLAIM OF PRIORITY

This application is a continuation of U.S. application Ser. No. 16/403,265, filed 3 May 2019, now issued as U.S. Pat. No. 10,555,395 on 4 Feb. 2020, which is hereby incorporated by reference in its entirety.

TECHNICAL FIELD

The subject matter disclosed herein relates to color tuning of one or more light-emitting diodes (LEDs) that comprise a lamp operating substantially in the visible portion of the electromagnetic spectrum. More specifically, the disclosed subject matter relates to a technique to enable a single color-tuning device (e.g., a dimmer) to select both a correlated color temperature (CCT) and a distance to the black body line (BBL) in a color-tuning application.

BACKGROUND

Light-emitting diodes (LEDs) are commonly used in various lighting operations. The color appearance of an object is determined, in part, by the spectral power density (SPD) of light illuminating the object. For humans viewing an object, the SPD is the relative intensity for various wavelengths within the visible light spectrum. However, other factors also affect color appearance. Also, both a correlated color temperature (CCT) of the LED, and a distance of the temperature of the LED on the CCT from a black-body line (BBL, also known as a black-body locus or a Planckian locus), can affect a human's perception of an object. In particular applications of LEDs, such as in retail and hospitality lighting applications, it may be desirable to control the distance of the color point of the LEDs to the black body line (BBL) on top of the correlated color temperature (CCT).

The information described in this section is provided to offer the skilled artisan a context for the following disclosed subject matter and should not be considered as admitted prior art.

DETAILED DESCRIPTION

Figure 1:
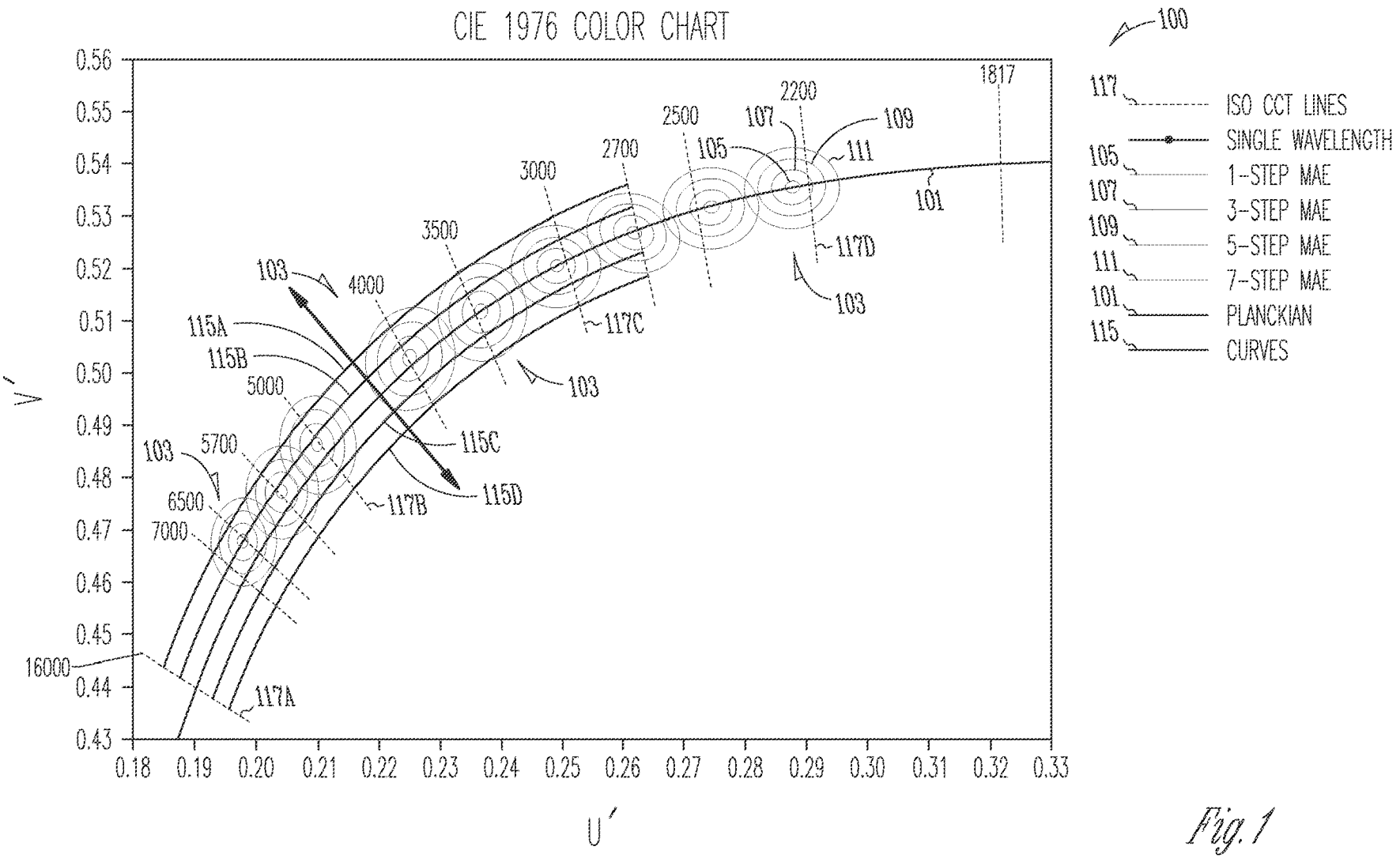
FIG. 1 shows a portion of an International Commission on Illumination (CIE) color chart, including a black body line (BBL) that forms a basis for understanding various embodiments of the subject matter disclosed herein.

The disclosed subject matter will now be described in detail with reference to a few general and specific embodiments as illustrated in various ones of the accompanying drawings. In the following description, numerous specific details are set forth in order to provide a thorough understanding of the disclosed subject matter. It will be apparent, however, to one skilled in the art, that the disclosed subject matter may be practiced without some or all of these specific details. In other instances, well-known process steps or structures have not been described in detail so as not to obscure the disclosed subject matter.

Examples of different light illumination systems and/or light emitting diode implementations will be described more fully hereinafter with reference to the accompanying drawings. These examples are not mutually exclusive, and features found in one example may be combined with features found in one or more other examples to achieve additional implementations. Accordingly, it will be understood that the examples shown in the accompanying drawings are provided for illustrative purposes only and they are not intended to limit the disclosure in any way. Like numbers refer generally to like elements throughout.

It will be understood that, although the terms first, second, third, etc. may be used herein to describe various elements, these elements should not be limited by these terms. These terms may be used to distinguish one element from another. For example, a first element may be termed a second element and a second element may be termed a first element without departing from the scope of the present invention. As used herein, the term "and/or" may include any and all combinations of one or more of the associated listed items.

It will also be understood that when an element is referred to as being "connected" or "coupled" to another element, it may be directly connected or coupled to the other element and/or connected or coupled to the other element via one or more intervening elements. In contrast, when an element is referred to as being "directly connected" or "directly coupled" to another element, there are no intervening elements present between the element and the other element. It will be understood that these terms are intended to encompass different orientations of the element in addition to any orientation depicted in the figures.

Relative terms such as "below." "above." "upper," "lower," "horizontal," or "vertical" may be used herein to describe a relationship of one element, zone, or region to another element, zone, or region as illustrated in the figures. It will be understood that these terms are intended to encompass different orientations of the device in addition to the orientation depicted in the figures.

Semiconductor-based light-emitting devices or optical power emitting devices, such as devices that emit ultraviolet (UV) or infrared (IR) optical power, are among the most efficient light sources currently available. These devices may include light emitting diodes, resonant-cavity light emitting diodes, vertical-cavity laser diodes, edge-emitting lasers, or the like (simply referred to herein as LEDs). Due to their compact size and low power requirements, for example, LEDs may be attractive candidates for many different applications. For example, they may be used as light sources (e.g., flash lights and camera flashes) for hand-held battery-powered devices, such as cameras and cell phones. They may also be used, for example, for automotive lighting, heads-up display (HUD) lighting, horticultural lighting, street lighting, a torch for video, general illumination (e.g., home, shop, office and studio lighting, theater/stage lighting, and architectural lighting), augmented reality (AR) lighting, virtual reality (VR) lighting, as back lights for displays, and IR spectroscopy. A single LED may provide light that is less bright than an incandescent light source, and, therefore, multi-junction devices or arrays of LEDs (such as monolithic LED arrays, micro LED arrays, etc.) may be used for applications where more brightness is desired or required.

In various environments where LED-based lamps (or related illumination devices) are used to illuminate objects as well as for general lighting, it may be desirable to control the distance of the color point of a lamp to the black body line (BBL) on top of a correlated color temperature (CCT). Such environments may include, for example, retail locations as well as hospitality locations such as restaurants and the like. In addition to the CCT, one lamp metric is the color-rendering index (CRI) of the lamp. The CRI is defined by the International Commission on Illumination (CIE) and provides a quantitative measure of an ability of any light source (including LEDs) to accurately represent colors in various objects in comparison with an ideal or natural light source. The highest possible CRI value is 100. Another quantitative lamp metric is $D_{uv}$. The $D_{uv}$ is a metric defined in, for example, CIE 1960, to represent the distance of a color point to the BBL. It is a positive value if the color point is above the BBL and negative if below. Color points above the BBL appear greenish and those below the BBL appear pinkish. The disclosed subject matter provides an apparatus to select and control both CCT and $D_{uv}$ in a color-tuning application.

FIG. 1 shows a portion of an International Commission on Illumination (CIE) color chart 100, including a black body line (BBL) 101 (also referred to as a Planckian locus) that forms a basis for understanding various embodiments of the subject matter disclosed herein. The BBL 101 shows the chromaticity coordinates for blackbody radiators of varying temperatures. It is generally agreed that, in most illumination situations, light sources should have chromaticity coordinates that lie on or near the BBL 101. Various mathematical procedures known in the art are used to determine the "closest" blackbody radiator. As noted above, this common lamp specification parameter is called the correlated color temperature (CCT). A useful and complementary way to further describe the chromaticity is provided by the DU value, which is an indication of the degree to which a lamp's chromaticity coordinate lies above the BBL 101 (a positive $D_{uv}$) or below the BBL 101 (a negative $D_{uv}$).

The portion of the color chart is shown to include a number of isothermal lines 117. Even though each of these lines is not on the BBL 101, any color point on the isothermal line 117 has a constant CCT. For example, a first isothermal line 117A has a CCT of 10,000 K, a second isothermal line 117B has a CCT of 5,000 K, a third isothermal line 117C has a CCT of 3,000 K, and a fourth isothermal line 117D has a CCT of 2,200 K.

With continuing reference to FIG. 1, the CIE color chart 100 also shows a number of ellipses that represent a Macadam Ellipse (MAE) 103, which is centered on the BBL 101 and extends one step 105, three steps 107, five steps 109, or seven steps 111 in distance from the BBL 101. The MAE is based on psychometric studies and defines a region on the CIE chromaticity diagram that contains all colors which are indistinguishable, to a typical observer, from a color at the center of the ellipse. Therefore, each of the MAE steps 105 to 111 (one step to seven steps) are seen to a typical observer as being substantially the same color as a color at the center of a respective one of the MAEs 103. A series of curves, 115A, 115B, 115C, and 115D, represent substantially equal distances from the BBL 101 and are related to $D_{uv}$ values of, for example, +0.006, +0.003, 0, −0.003 and −0.006, respectively.

Figure 2A:
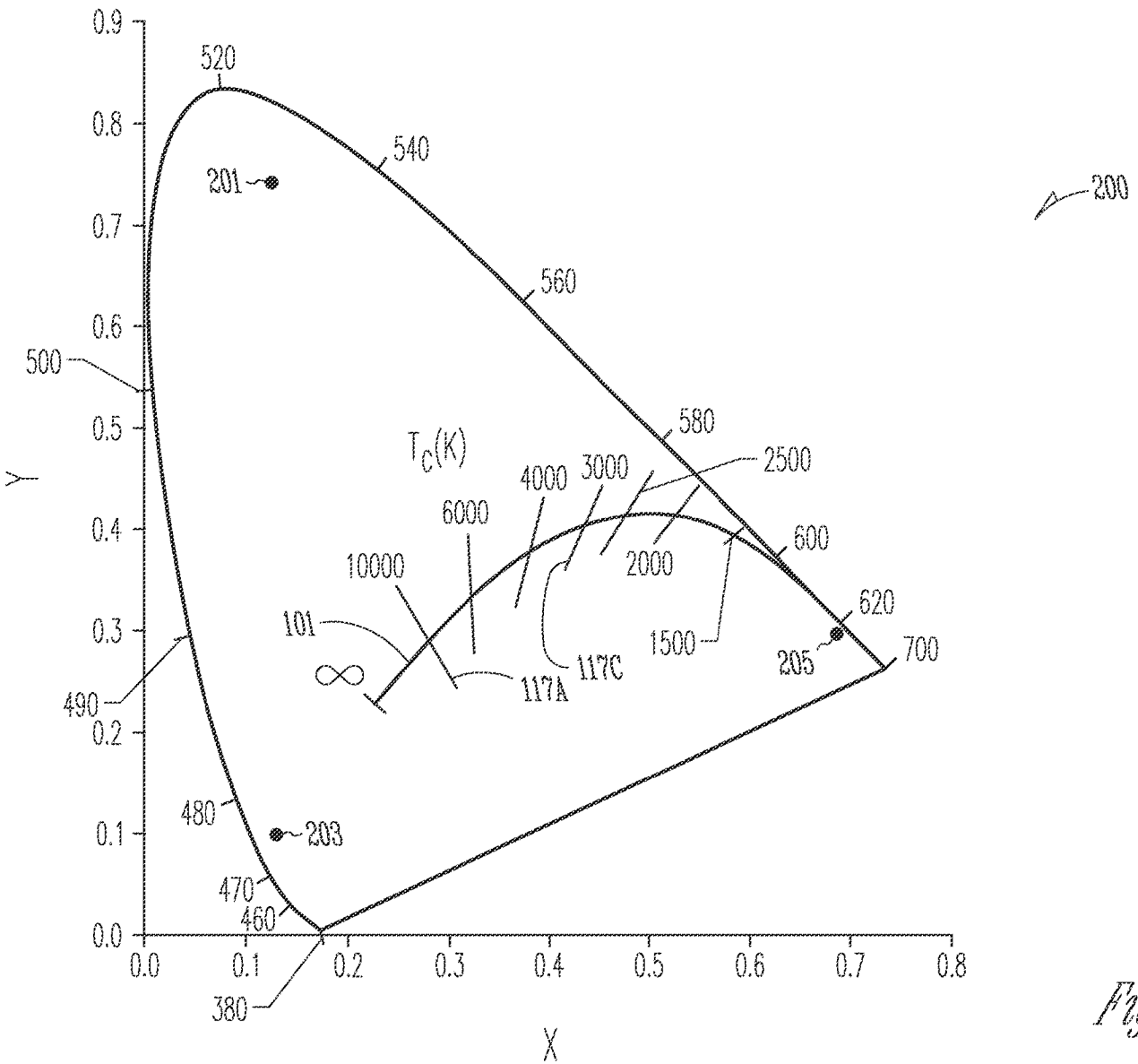
FIG. 2A shows a chromaticity diagram with approximate chromaticity coordinates of colors for typical red (R), green (G), and blue (B) LEDs, on the diagram, and including a BBL.

Referring now to FIG. 2A, and with continuing reference to FIG. 1, FIG. 2A shows a chromaticity diagram 200 with approximate chromaticity coordinates of colors for typical coordinate values (as noted on the x-y scale of the chromaticity diagram 200) for a red (R) LED at coordinate 205, a green (G) LED at coordinate 201, and a blue (B) LED at coordinate 203. FIG. 2A shows an example of the chromaticity diagram 200 for defining the wavelength spectrum of a visible light source, in accordance with some embodiments. The chromaticity diagram 200 of FIG. 2A is only one way of defining a wavelength spectrum of a visible light source: other suitable definitions are known in the art and can also be used with the various embodiments of the disclosed subject matter described herein.

A convenient way to specify a portion of the chromaticity diagram 200 is through a collection of equations in the x-y plane, where each equation has a locus of solutions that defines a line on the chromaticity diagram 200. The lines may intersect to specify a particular area, as described below in more detail with reference to FIG. 2B. As an alternative definition, the white light source can emit light that corresponds to light from a blackbody source operating at a given color temperature.

The chromaticity diagram 200 also shows the BBL 101 as described above with reference to FIG. 1. Each of the three LED coordinate locations 201, 203, 205 are the CCT coordinates for "fully-saturated" LEDs of the respective colors green, blue, and red. However, if a "white light" is created by combining certain proportions of the R, G, and B LEDs, the CRI of such a combination would be extremely low. Typically, in the environments described above, such as retail or hospitality settings, a CRI of about 90 or higher is desirable.

Figure 2B:
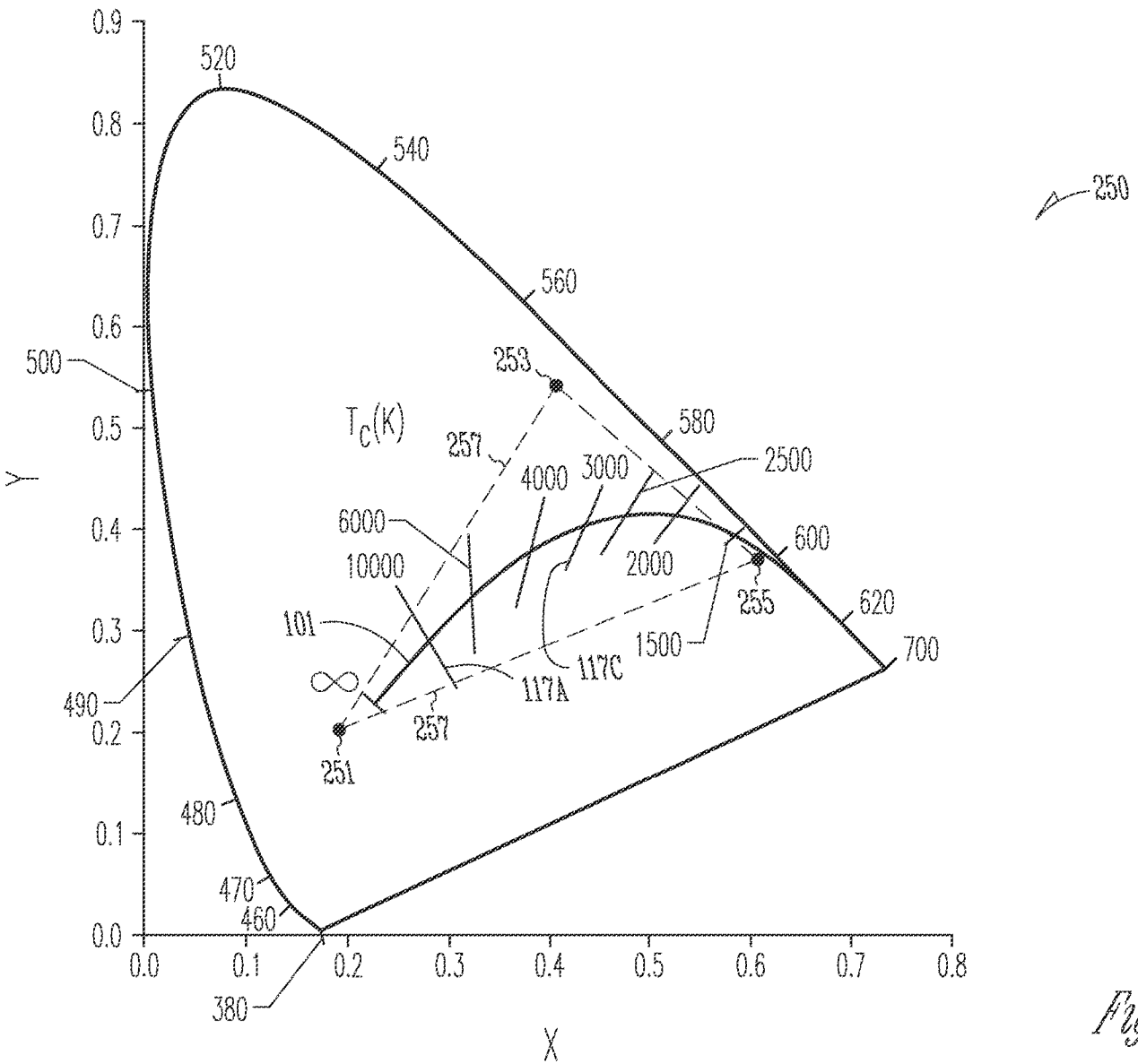
FIG. 2B shows a revised version of the chromaticity diagram of FIG. 2A, with approximate chromaticity coordinates for desaturated R, G, and B LEDs in proximity to the BBL, in accordance with various embodiments of the disclosed subject matter.

FIG. 2B shows a revised version of the chromaticity diagram 200 of FIG. 2A. However, the chromaticity diagram 250 of FIG. 2B shows approximate chromaticity coordinates for desaturated R, G, and B LEDs in proximity to the BBL 101. Coordinate values (as noted on the x-y scale of the chromaticity diagram 250) are shown for a desaturated red (R) LED at coordinate 255, a desaturated green (G) LED at coordinate 253, and a desaturated blue (B) LED at coordinate 251. In various embodiments, a color temperature range of the desaturated R. G, and B LEDs may be in a range from about 1800 K to about 2500 K. In other embodiments, the desaturated R, G, and B LEDs may be in a color temperature range of about 2700 K to about 6500 K. As noted above, the color rendering index (CRI) of a light source does not indicate the apparent color of the light source; that information is given by the correlated color temperature (CCT). The CR is therefore a quantitative measure of the ability of a light source to reveal the colors of various objects faithfully in comparison with an ideal or natural light source.

In a specific exemplary embodiment, a triangle 257 formed between each of the coordinate values for the desaturated R, G, and B LEDs is also shown. The desaturated R, G, and B LEDs are formed (e.g., by a mixture of phosphors and/or a mixture of materials to form the LEDs as is known in the art) to have coordinate values in proximity to the BBL 101. Consequently, the coordinate locations of the respective desaturated R. G, and B LEDs, and as outlined by the triangle 257, has a CRI have approximately 90 or greater. Therefore, the selection of both a correlated color temperature (CCT) and a distance, $D_{uv}$, to the black body line (BBL) may be selected in the color-tuning application described herein such that all combinations of CCT and $D_{uv}$ selected all result in the lamp having a CRI of 90 or greater. Each of the desaturated R, G, and B LEDs may comprise a single LED or an array (or group) of LEDs, each LED within the array or group having a desaturated color the same as or similar to the other LEDs within the array or group. A combination of the one or more desaturated R, G, and B LEDs comprises a lamp.

Figure 3:
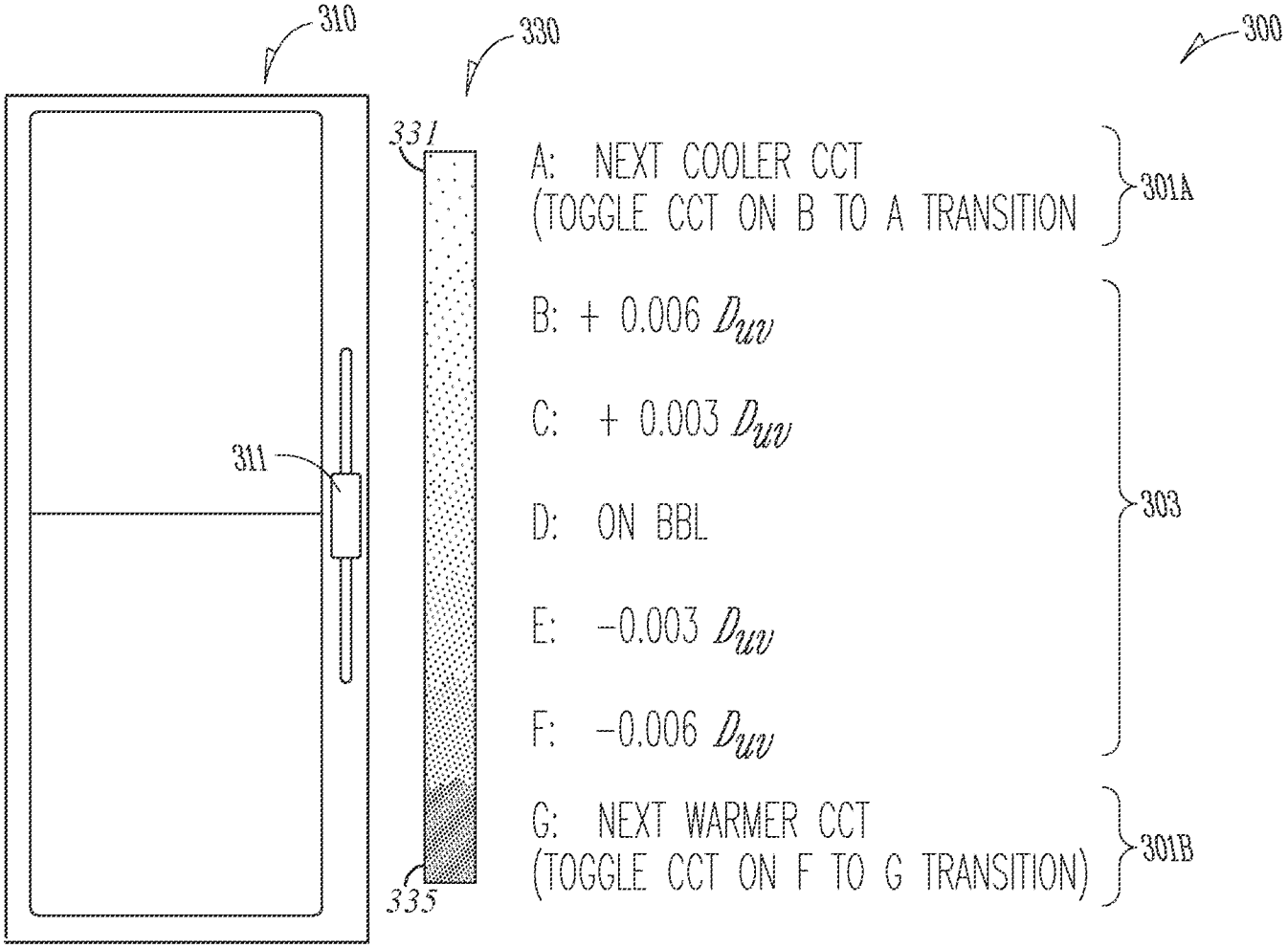
FIG. 3 shows an exemplary embodiment of a color-tuning device in accordance with various embodiments of the disclosed subject matter.

FIG. 3 shows an exemplary embodiment of an apparatus 300 including a color-tuning device 310 in accordance with various embodiments of the disclosed subject matter. In one specific exemplary embodiment, the color-tuning device 310 is a 0 volt to 10 volt dimmer that is adapted to function as a one-dimensional control. The 0-to-10 volt dimmer is traditionally used for flux dimming. A position of a slider 311, as described in detail below, is used to select both CCT and DA, of a controlled lamp (not shown). In various embodiments, the slider 311 comprises a voltage divider. The slider may therefore be a linearly-operated device or a rotary device. An algorithm, described in detail in the form a finite-state machine, is described in detail below with reference to FIG. 4. As used herein, an algorithm, such as the finite-state machine, is a self-consistent sequence of operations or similar processing leading to a desired result. In this context, the algorithms and operations involve physical manipulation of physical quantities. The algorithm reacts to a position of the slider 311, as well a path of travel of the slider 311. Due to both a position and a path of travel of the slider 311, two operational modes are introduced into the one-dimensional slider to navigate a two-dimensional color space 330 (shown as a reference only), where cooler colors are located in an uppermost position 331 of the two-dimensional color space 330 and warmer colors are located in a lowermost position 335 of the two-dimensional color space 330. Although not shown, a person of ordinary skill in the art will understand that an additional dimmer may be wired in series with the color-tuning device 310 for standard flux dimming operations of the lamp.

Figure 4:
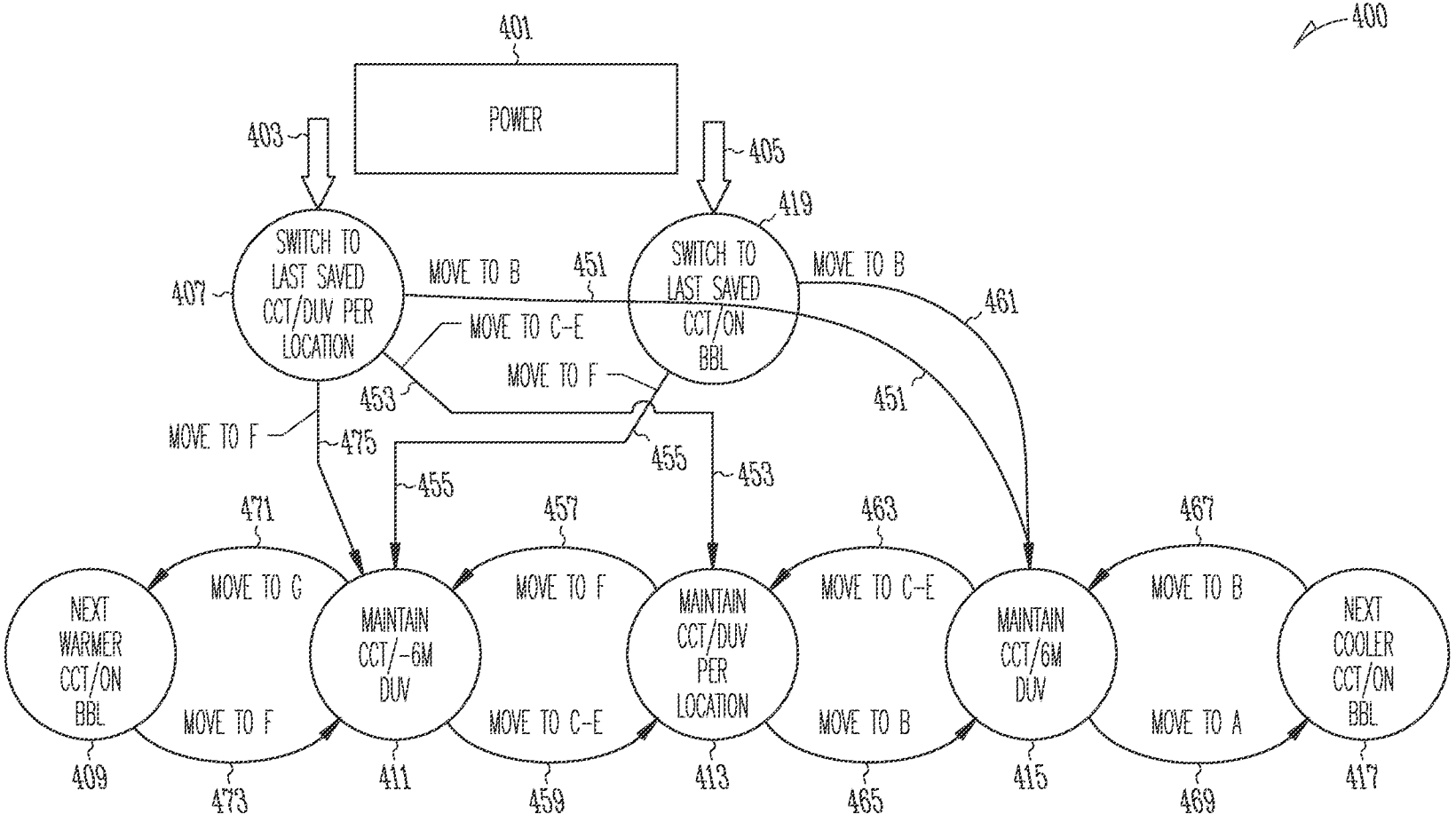
FIG. 4 shows an exemplary embodiment of a finite-state machine diagram, used by the color-tuning device of FIG. 3, in accordance with various embodiments of the disclosed subject matter.

A position of the slider 311 of the color-tuning device 310 (e.g., the dimmer) is divided into a plurality of zones. In the specific exemplary embodiment shown if FIG. 3, seven zones are defined. In this example, a position A 301A moves the lamp to the next cooler CCT coordinate (e.g., to a higher color temperature) on the chromaticity graph (e.g., the chromaticity diagram 250 of FIG. 2B). A position G 301B moves the lamp to the next warmer CCT coordinate (e.g., to a lower color temperature) on the chromaticity graph. Five $D_{uv}$ zones 303 are defined for the mid-range positions of the slider 311. In this example, the five $D_{uv}$ zones 303 are to increase a $D_{uv}$ from the BBL 101 (see FIG. 1) to position B, having an increase in $D_{uv}$ of +0.006; position C, having an increase in $D_{uv}$ of +0.003; position D, which keeps the color point of the lamp at the current CCT on the BBL 101: position E, having a decrease in $D_{uv}$ of −0.003; and position F, having a decrease in $D_{uv}$ of −0.003. Therefore, position A 301A and position G 301B are for CCT toggling while the five $D_{uv}$ zones 303 are for setting the lamp a pre-defined coordinate distance from the BBL 101. FIG. 4 describes the related finite-state machine in detail that allows accommodating these seven zones.

Although the specific exemplary embodiment of FIG. 3 shows a total of seven zones (or positions), as few as four zones may be defined. For example, two zones are used to toggle CCT values of the lamp, while two of the zones (e.g., a subset of the five $D_{uv}$ zones 303) are used to for setting the lamp a pre-defined coordinate distance from the BBL 101. For example, the two $D_{uv}$ zones may be predetermined to be ±0.006, +0.003, or some other combination of positive and negative values of $D_{uv}$. In other embodiments, the two $D_{uv}$ zones may be predetermined to be ±0.006 and −0.003, or +0.003 and −0.006, or a variety of other combinations. In still other embodiments, three $D_{uv}$ zones may be selected with one of the three $D_{uv}$ zones selected to be on the BBL 101. In this embodiment, the remaining two $D_{uv}$ zones may be selected to be one of the combinations of $D_{uv}$ described above with reference to the two $D_{uv}$ zones.

Although more than seven zones may also be selected in other embodiments, a practical upper limit to a number of zones may be about ten. More than ten zones can make it difficult for an end user to set a location of the slider 311 precisely.

Using the specific exemplary embodiment of the apparatus 300 above in which there are seven zones, a typical output range of a 0-to-10 volt dimmer is approximately between about 1 V and 9 V. In this example, a first voltage is mapped below 2.5 V to zone G and above 7.5 V to zone A.

The range of 2.5 V to 7.5 V is then divided approximately equally between the five $D_{uv}$ zones 303 (zones B through F). Inside a microcontroller (not shown but located in, for example, the color-tuning device 310 or in the controller described with reference to FIG. 5), control parameters are stored in a two-dimensional matrix. One example of the two-dimensional matrix is shown in Table I, below. One dimension corresponds to predefined CCT values and the other dimension corresponds to $D_{uv}$. Data for the same CCT are stored in the same column. The dimmer voltage range of 0 V to 10 V may then be periodically digitized so that a particular voltage can be assigned to one of the seven zones.

In various embodiments, the two-dimensional matrix shown by Table I does not need to be filled in completely. Table I includes certain exemplary matrix-values only to provide an example. A person of ordinary skill in the art will recognize how actual values should be included based on upon reading and understanding the disclosed subject matter provided herein. For example, certain $D_{uv}$ values could be skipped for certain CCT values. Therefore, certain ones of the exemplary CCT or $D_{uv}$ matrix-values shown in Table I may be, for example. "0" or "Not Applicable" (NA). Further, $D_{uv}$ values on the same row do not necessarily need to be equal for all CCT values. In other embodiments, the two-dimensional matrix could also be irregular in shape, wherein certain CCT values may contain more $D_{uv}$ values than other CCT values. Consequently, the data structure of Table I is one example only and is therefore only one of many possibilities that can be implemented in a microcontroller or other device as discussed below in more detail with reference to, for example, FIG. 5.

While the first element of the apparatus 300 of FIG. 3 is the color-tuning device, the second element of the apparatus 300 is a finite-state machine that determines an action to take based on both the current position and a previous position of the slider 311. An exemplary embodiment of the finite-state machine is shown and described in detail with reference to FIG. 4, below.

TABLE I

| CCT Values | | | | | |
|---|---|---|---|---|---|
| $CCT_1$ | $CCT_2$ | $CCT_3$ | $CCT_4$ | CCT5 | $CCT_6$ |
| $D_{uv}$ VALUES | | | | | |
| $D_{uv1}$ | $D_{uv2}$ | $D_{uv3}$ | $D_{uv4}$ | $D_{uv5}$ | $D_{uv6}$ |
| $D_{uv7}$ | $D_{uv8}$ | $D_{uv9}$ | $D_{uv10}$ | $D_{uv11}$ | $D_{uv12}$ |
| $D_{uv13}$ | $D_{uv14}$ | $D_{uv15}$ | $D_{uv16}$ | $D_{uv17}$ | $D_{uv18}$ |
| $D_{uv19}$ | $D_{uv20}$ | $D_{uv21}$ | $D_{uv22}$ | $D_{uv23}$ | $D_{uv24}$ |

With reference now to FIG. 4, and with continuing reference to MG. 3, an exemplary embodiment of a finite-state machine diagram 400, used by the color-tuning device 310, is shown. In various embodiments, one or more micro-controllers (not shown) operates in accordance with the finite-state machine diagram 400, to determine which cell in Table I will be read out. As noted above, the one or more microcontrollers may be embedded within, for example, the color-tuning device 310, or contained within a controller box 501 as described with reference to FIG. 5, below.

Two actions are defined by Table I. One action is to toggle the CCT of the desaturated LEDs (e.g., LEDs within a lamp, see FIG. 2B) upward or downward in color temperature. As described above, this change in CCT action is triggered by a transition either from B-to-A or from F-to-G. The other action is to set the which is determined by a current position of the slider 311. The one or more microprocessors is able to save the CCT value after each toggle so that the lamp is turned on with the previous CCT setting after a power cycle by a power switch 401.

With continuing reference to FIG. 4, in a first path 403 within the finite-state machine diagram 400, the slider 311 stops at a location other than A (next cooler CCT) or G (next warmer CCT). After the power switch 401 is turned on, the color-tuning device 310 enters the finite-state machine diagram at state 407, where the lamp is switched to a last-saved CCT/$D_{uv}$ position. Based on an input from the slider 311, several transitions to other states are possible. From state 407, one transition along path 451 to position B moves to state 415, where the current CCT is maintained while a change of +0.006 $D_{uv}$ occurs. Also, from state 407, another transition along path 453 from position C-to-E to state 413 may be selected, where the CCT and $D_{uv}$ positions per location are maintained. Another transition along path 475 from state 407 to state 411 may be selected, where the current CCT is maintained while a change of −0.006 $D_{uv}$ occurs.

From state 411, a transition along path 471 may be selected to position G on the slider 311, to state 409, where a next warmer CCT on the BBL occurs. From state 409, a transition along path 473 may be selected to position F on the slider 311, back to state 411, described above. Also, from state 411, a transition along path 459 may be selected from position C-to-E on the slider 311, to state 413, also described above. From state 413, a transition along path 457 may be selected to position F on the slider 311, back to state 411. In another transition from state 413 along path 465, to position B on the slider 311 moves to state 415, where the current CCT is maintained while a change of +0.006 $D_{uv}$ occurs, as described above with reference to state 415. From state 415, a transition along path 463 may be selected from position C-to-E on the slider 311, back to state 413.

From state 415, a transition along path 469 may be selected to position A on the slider 311, to state 417, where a next cooler CCT on the BBL occurs. From state 417, a transition along path 467 may be selected to position B on the slider 311, back to state 415, described above.

In addition to those states and transitions on the finite-state machine diagram 400 already described, in a second path 405 within the finite-state machine diagram 400, the slider 311 stops at either location A (next cooler CCT) or G (next warmer CCT). After the power switch 401 is turned on, the color-tuning device 310 enters the finite-state machine diagram at state 419, where the lamp is switched to a last-saved CCT position that is on the BBL. Based on an input from the slider 311, two transitions to other states are possible. From state 419, one transition along path 455 to position F on the slider moves to state 411, where the current CCT is maintained while a change of −0.006 $D_{uv}$ occurs. Also, from state 419, another transition along path 461 to position B on the slider 311 to state 415 may be selected, where the CCT is maintained while a change of −0.006 $D_{uv}$ occurs.

EXAMPLES OF CHANGING THE SLIDER POSITION

Example 1: With reference again to FIGS. 3 and 4, when the lamp is turned on for the first, the dimmer slider is at a position (e.g., position E of FIG. 3) of −0.003 $D_{uv}$. The lamp CCT will default to its factory setting for color temperature of, for example, 3000 K. At the same time, the color point will move to −0.003 $D_{uv}$.

Example 2: An end user moves the slider 311 all the way up to position A. The slider 311 movement triggers the lamp to switch to the next cooler CCT. The color point will then return to the BBL or to whatever value is default to that CCT. In order to toggle the lamp again, the end user moves the slider 311 out from position A and then back to position A. This step of moving the slider 311 from position A back to position A is repeated until the desired CCT is selected. The user then moves the slider 311 between positions B through F to choose a suitable $D_{uv}$. Finally, the end user settles on a CCT of 5700 K and 0.003 $D_{uv}$.

Example 3: An end user switches the lamp off and subsequently switches the lamp back on. The lamp returns to its previously saved CCT setting, which in this example is 5700 K. As long as the slider 311 position has not been changed, the lamp will start in 5700 K and 0.003 $D_{uv}$.

Figure 5:
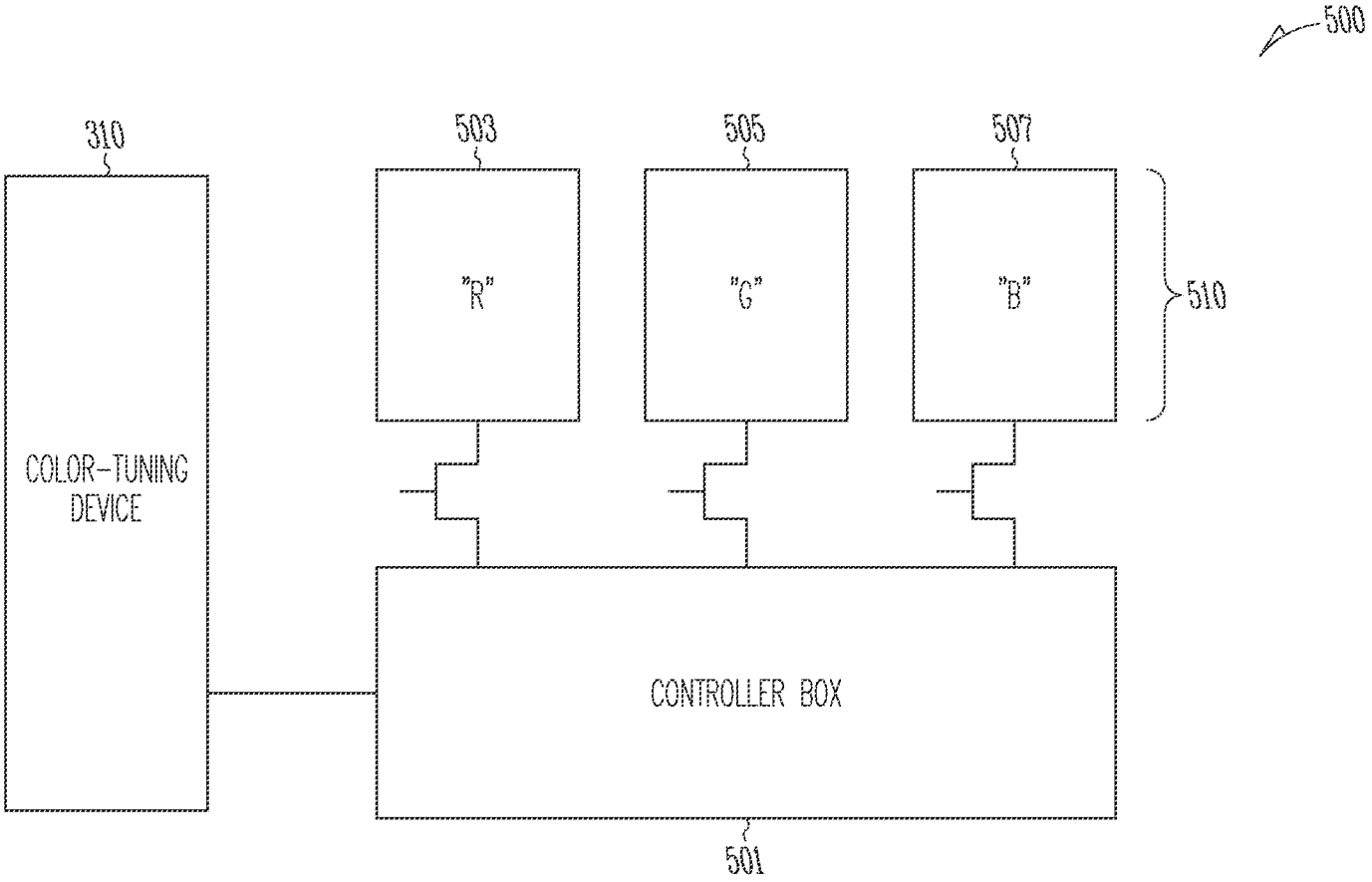
FIG. 5 shows a high-level schematic diagram of the color-tuning device, a controller box, and the desaturated LEDs of FIG. 2B.

With reference now to FIG. 5, a high-level schematic diagram 500 of the color-tuning device 310, a controller box 501, and the desaturated LEDs (an "R" LED 503, a "G" LED 505, and a "B" LED 507) of FIG. 2B are shown. The "R" LED 503, the "G" LED 505, and the "B" LED 507 comprise a lamp 510. Also, each of the "R" LED 503, the "G" LED 505, and the "B" LED 507 may be comprised of one or more LEDs of the appropriate desaturated color (R, G, or B).

As is known to a person of ordinary skill in the art, since light output of an LED is proportional to an amount of current used to drive the LED, dimming an LED can be achieved by, for example, reducing the forward current transferred to the LED. Based on pre-determined values from Table I, and either a present position or a transition of the slider 311 of the color-tuning device 310 (as noted in the finite-state machine diagram 400 of FIG. 4 described above), the controller box 501 reads converted signals (e.g., from an analog signal to a digital signal through an analog-to-digital converter (A/D converter or ADC)) transferred from the color-tuning device 310 and send a pre-determined amount of current to one, two, or all three of the LEDs to change an overall CCT and/or D level of the lamp 510. Although not shown explicitly, the A/D converter may be located within the color-tuning device 310, within the controller box 501, or as a separate A/D converter device.

In addition to or instead of changing an amount of current used to drive each of the individual "I" LED 503, the "G" LED 505, and the "B" LED 507, the controller box 501 may rapidly switch selected ones of the LEDs between "on" and "off" states to achieve an appropriate level of dimming for the selected lamp in accordance with intensities needed to be in accordance with the finite-state machine diagram 400 of FIG. 4. In embodiments, the controller box 501 may be a three-channel converter, known in the art. Upon reading and understanding the disclosed subject matter, a person of ordinary skill in the art will recognize that the individual LEDs comprising the lamp 510 may be controlled in other ways as well.

In various embodiments, one or more modules may contain and/or interpret the finite-state machine described with reference to FIG. 4. Part or all of these modules may be contained within the controller box 501. In some embodiments, the modules may constitute software modules (e.g., code stored or otherwise embodied in a machine-readable medium or in a transmission medium), hardware modules, or any suitable combination thereof. A "hardware module" is a tangible (e.g., non-transitory) physical component (e.g., a set of one or more microprocessors or other hardware-based devices) capable of performing certain operations and interpreting the finite-state machine. The one or more modules may be configured or arranged in a certain physical manner. In various embodiments, one or more microprocessors or one or more hardware modules thereof may be configured by software (e.g., an application or portion thereof) as a hardware module that operates to perform operations described herein for that module.

In some example embodiments, a hardware module may be implemented, for example, mechanically or electronically, or by any suitable combination thereof. For example, a hardware module may include dedicated circuitry or logic that is permanently configured to perform certain operations. A hardware module may be or include a special-purpose processor, such as a field-programmable gate array (FPGA) or an application specific integrated circuit (ASIC). A hardware module may also include programmable logic or circuitry that is temporarily configured by software to perform certain operations, such as interpretation of the various states and transitions within the finite-state machine. As an example, a hardware module may include software encompassed within a CPU or other programmable processor. It will be appreciated that the decision to implement a hardware module mechanically, electrically, in dedicated and permanently configured circuitry, or in temporarily configured circuitry (e.g., configured by software) may be driven by cost and time considerations.

The description above includes illustrative examples, devices, systems, and methods that embody the disclosed subject matter. In the description, for purposes of explanation, numerous specific details were set forth in order to provide an understanding of various embodiments of the disclosed subject matter. It will be evident, however, to those of ordinary skill in the art that various embodiments of the subject matter may be practiced without these specific details. Further, well-known structures, materials, and techniques have not been shown in detail, so as not to obscure the various illustrated embodiments.

As used herein, the term "or" may be construed in an inclusive or exclusive sense. Further, other embodiments will be understood by a person of ordinary skill in the art upon reading and understanding the disclosure provided. Further, upon reading and understanding the disclosure provided herein, the person of ordinary skill in the art will readily understand that various combinations of the techniques and examples provided herein may all be applied in various combinations.

Although various embodiments are discussed separately, these separate embodiments are not intended to be considered as independent techniques or designs. As indicated above, each of the various portions may be inter-related and each may be used separately or in combination with other types of electrical control devices, such as dimmers and related devices. Consequently, although various embodiments of methods, operations, and processes have been described, these methods, operations, and processes may be used either separately or in various combinations.

Consequently, many modifications and variations can be made, as will be apparent to a person of ordinary skill in the art upon reading and understanding the disclosure provided herein. Functionally equivalent methods and devices within the scope of the disclosure, in addition to those enumerated herein, will be apparent to the skilled artisan from the foregoing descriptions. Portions and features of some embodiments may be included in, or substituted for, those of others. Such modifications and variations are intended to fall within a scope of the appended claims. Therefore, the present disclosure is to be limited only by the terms of the appended claims, along with the full scope of equivalents to which such claims are entitled. It is also to be understood that the terminology used herein is for the purpose of describing particular embodiments only and is not intended to be limiting.

The Abstract of the Disclosure is provided to allow the reader to quickly ascertain the nature of the technical disclosure. The abstract is submitted with the understanding that it will not be used to interpret or limit the claims. In addition, in the foregoing Detailed Description, it may be seen that various features may be grouped together in a single embodiment for the purpose of streamlining the disclosure. This method of disclosure is not to be interpreted as limiting the claims. Thus, the following claims are hereby incorporated into the Detailed Description, with each claim standing on its own as a separate embodiment.

What is claimed is:

1. A color-tuning apparatus, comprising:

a finite-state machine configured to be coupled to a color-tuning device to determine an action to take, with regard to at least one of a correlated color temperature (CCT) and a coordinate distance ($D_{uv}$) from a black body line (BBL), based on both a current position and a previous position of the color-tuning device; and a controller to receive a plurality of signals from the color-tuning device and correlate the plurality of signals to actions indicated in the finite-state machine, the controller being configured to control at least one light-emitting diode (LED) driver.

2. The color-tuning apparatus of claim 1, wherein the color-tuning device is to divide a voltage applied thereto, the divided voltage being configured to provide a signal related to at least one parameter selected from parameters including the correlated color temperature (CCT) and the coordinate distance ($D_{uv}$) from a black body line.

3. The color-tuning apparatus of claim 1, wherein the color-tuning device is a 0-volt to 10-volt dimmer to function as a one-dimensional control device to set both the CCT and the $D_{uv}$ of an LED array.

4. The color-tuning apparatus of claim 1, wherein the color-tuning device is divided into a plurality of zones.

5. The color-tuning apparatus of claim 1, wherein the color-tuning device is divided into seven zones.

6. The color-tuning apparatus of claim 1, further comprising:

an LED array coupled to the controller and having at least one desaturated red (R) LED, at least one desaturated green (G) LED; and at least one desaturated blue (B) LED; each of the at least one desaturated R LED, the desaturated G LED; and the desaturated B LED having coordinates on a chromaticity diagram that are in proximity to the black body line.

7. The color-tuning apparatus of claim 6, wherein:

a first position of the color-tuning device and a last position of the color-tuning device are configured, respectively, to control the LED array to a subsequently higher color temperature and a subsequently lower color temperature; and mid-range positions of the color-tuning device are configured to control at least individual LEDs within the LED array to a pre-determined coordinate position selected from a value of $D_{uv}$ above the BBL and a value of $D_{uv}$ below the BBL.

8. The color-tuning apparatus of claim 7, wherein a maximum value of the $D_{uv}$ is at seven steps on a MacAdam Ellipse.

9. The color-tuning apparatus of claim 7, wherein values of $D_{uv}$ include coordinate steps sizes of ±0.006, ±0.003, and 0.

10. The color-tuning apparatus of claim 6, further comprising a dimmer coupled in series with the color-tuning device and the LED array to control flux dimming of the LED array.

11. The color-tuning apparatus of claim 1, wherein the CCT and the coordinate distance, $D_{uv}$, from the black body line comprise a two-dimensional color space.

12. The color-tuning apparatus of claim 1, wherein all combinations of CCT and $D_{uv}$ selected result in a color-rendering index (CRI) of the lamp of about 90 or greater.

13. A color-tuning apparatus, comprising:

a finite-state machine coupled to receive a signal from a color-tuning device to determine an action to take, with regard to at least one parameter selected from parameters including a correlated color temperature (CCT) and a coordinate distance ($D_{uv}$) from a black body line (BBL) for at least one light-emitting diode (LED) array, based on both a current position and a previous position of the color-tuning device.

14. The color-tuning apparatus of claim 13, wherein the color-tuning device comprises a voltage-divider mechanism, the voltage-divider mechanism being a one-dimensional mechanism to divide a voltage applied to the color-tuning device, the divided voltage being configured to provide a signal related to the at least one parameter including the CCT and the coordinate distance, $D_{uv}$, from the BBL for the at least one LED array.

15. The color-tuning apparatus of claim 13, further comprising a controller to receive a plurality of signals from the color-tuning device and correlate the plurality of signals to actions indicated in the finite-state machine, the controller including a plurality of LED drivers.

16. The color-tuning apparatus of claim 13, wherein the at least one LED array comprises at least one desaturated red (R) LED, at least one desaturated green (G) LED; and at least one desaturated blue (B) LED; each of the at least one desaturated R LED, the desaturated G LED; and the desaturated B LED having coordinates on a chromaticity diagram that are in proximity to the BBL.

17. The color-tuning apparatus of claim 13, wherein the color-tuning device is a 0-volt to 10-volt dimmer to function as a one-dimensional control device to set both the CCT and the $D_{uv}$ of the at least one LED array.

18. A system to control color-tuning, the system comprising:

a color-tuning device having a voltage-divider mechanism located thereon, the voltage-divider mechanism being a one-dimensional mechanism to divide a voltage applied to the color-tuning device, the divided voltage being configured to provide a signal related to at least one of a correlated color temperature (CCT) and a coordinate distance ($D_{uv}$) from a black body line (BBL) for the illumination device; and a finite-state machine coupled to the color-tuning device to determine an action to take, with regard to at least one of CCT and $D_{uv}$, based on both a current position and a previous position of the voltage-divider mechanism.

19. The system of claim 18, further comprising a light-emitting diode (LED) array and having at least one desaturated red (R) light-emitting diode (LED), at least one desaturated green (G) LED; and at least one desaturated blue (B) LED; each of the at least one desaturated R LED, the desaturated G LED; and the desaturated B LED having coordinates on a chromaticity diagram that are in proximity to the BBL.

20. The system of claim 18, further comprising a controller to receive a plurality of signals from the color-tuning device and correlate the plurality of signals to actions indicated in the finite-state machine, the controller including a plurality of light-emitting diode (LED) drivers to drive and control an LED array.

21. The system of claim 18, wherein:

a first position of the voltage-divider mechanism and a last position of the voltage-divider mechanism are configured, respectively, to control an LED array to a subsequently higher color temperature and a subsequently lower color temperature; and mid-range positions of the voltage-divider mechanism are configured to control the LED array to a pre-determined coordinate position selected from a value of $D_{uv}$ above the BBL and a value of $D_{uv}$ below the BBL.

22. The system of claim 18, wherein all combinations of CCT and $D_{uv}$ selected result in a color-rendering index (CRI) of the lamp of about 90 or greater.

23. The system of claim 18, wherein the CCT and the coordinate distance, $D_{uv}$, from the BBL comprise a two-dimensional color space.

* * * * *